United States Patent [19]

Saitoh

[11] 4,068,401

[45] Jan. 17, 1978

[54] SELF-POWERED TOY ANIMAL

[75] Inventor: Shigeru Saitoh, Tokyo, Japan

[73] Assignee: Masudaya Toy Company Limited, Tokyo, Japan

[21] Appl. No.: 706,525

[22] Filed: July 19, 1976

[30] Foreign Application Priority Data

| | | |
|---|---|---|
| Aug. 19, 1975 | Japan | 50-114212[U] |
| May 6, 1976 | United Kingdom | 18644/76 |

[51] Int. Cl.[2] ..... A63H 23/10; A63H 14/02

[52] U.S. Cl. ..... 46/92; 46/119; 46/123; 46/141

[58] Field of Search ..... 46/91, 92, 119, 123, 46/141

[56] References Cited

U.S. PATENT DOCUMENTS

| | | | |
|---|---|---|---|
| 2,648,935 | 8/1953 | Nagel | 46/92 |
| 2,704,416 | 3/1955 | Laird | 46/92 |
| 2,803,921 | 8/1957 | Garcia-Galiano | 46/141 |
| 3,008,267 | 11/1961 | Schneider | 46/141 |
| 3,808,734 | 5/1974 | Suzuki | 46/91 |

*Primary Examiner*—Russell R. Kinsey
*Assistant Examiner*—Robert F. Cutting
*Attorney, Agent, or Firm*—Michael J. Striker

[57] ABSTRACT

A self-powered toy comprises a relatively small toy animal and a relatively large toy animal having an openable mouth. A reel provided inside the large animal is connected to a drive and has a line connected to it that extends out the mouth of the large animal and is attached to the smaller animal. In addition the large animal, which may be constituted as a floatable fish or the like, is provided with means for propelling it through the water so that the drive unit can propel this large animal through the water and simultaneously reel in the small animal. Thus the large animal will appear to pursue and then eat the small animal as it pulls the small animal into its openable mouth.

7 Claims, 8 Drawing Figures

SELF-POWERED TOY ANIMAL

BACKGROUND OF THE INVENTION

The present invention relates to a toy. More particularly this invention concerns a toy animal of the windup type.

Toys are known which resemble animals and are capable of displacing themselves along the land or in water. Such toys frequently are very limited in their function so that their appeal for children is similarly limited. Thus after a very short time a child is bored with his or her toy and abandons it.

SUMMARY OF THE INVENTION

It is therefore an object of the present invention to provide an improved toy.

Another object is the provision of an improved toy animal which has long-lasting appeal for children.

These objects are attained according to the present invention in a toy comprising a relatively small toy animal, and a relatively large toy animal connected via a line to the smaller animal and provided in its interior with a reel and a drive for reeling in the smaller animal. The large animal has an openable mouth through which the line extends to that at it reels the smaller animal in it appears to eat this smaller animal.

In accordance with the present invention both of the toy animals are made to float and the smaller animal is formed as a fish. The larger animal may be another fish, a hippopotamus, a duck or a similar fish-eating animal. This larger animal has a body part and a face part hinged on the body part and defining therewith the openable mouth.

According to yet another feature of this invention the drive means is a spring windup mechanism carrying the reel to which the one end of the line is attached. This line may be a flexible string, chain, or other flexible relatively inextensible element. In order to simplify functioning of the device the spring windup mechanism is wound up simply by opening the mouth of the large animal and pulling the small animal out of the interior of the large animal. This causes the line to unwind from the reel and thereby winds up the larger animal so that when the smaller animal is released the windup mechanism will reel it in.

According to yet another feature of this invention means is provided for displacing the larger animal through the water or along the land. This means is connected to the drive means so that as the smaller animal is being pulled in the large animal follows along behind it, appearing to pursue, catch and eat the smaller animal. In accordance with this invention such displacement means may be a paddle formed as a tailfin of a fish constituting the larger animal, paddles carried on feet of a hippopotamus constituting the large animal, or paddles constituting the feet of a duck that is the larger animal.

According to further features of this invention the paddles are displaceable through substantially 90° between a position extending parallel to the normal direction of travel and backwardly therein in a position extending transverse to this direction. Thus as the element carrying the paddle moves forward the paddle swings into a position parallel to the direction of travel so that it does not tend to pull the large animal backwardly, but when moved in the opposite direction the paddle straightens out and gives the large animal a forward impetus.

The toy according to the present invention has a long-lasting appeal for a youngster, as it does more than simply paddle along in the water. Furthermore, such a toy can be produced at relatively low cost and will have a long service life.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

SPECIFIC DESCRIPTION OF PREFERRED EMBODIMENTS

Figure 1:
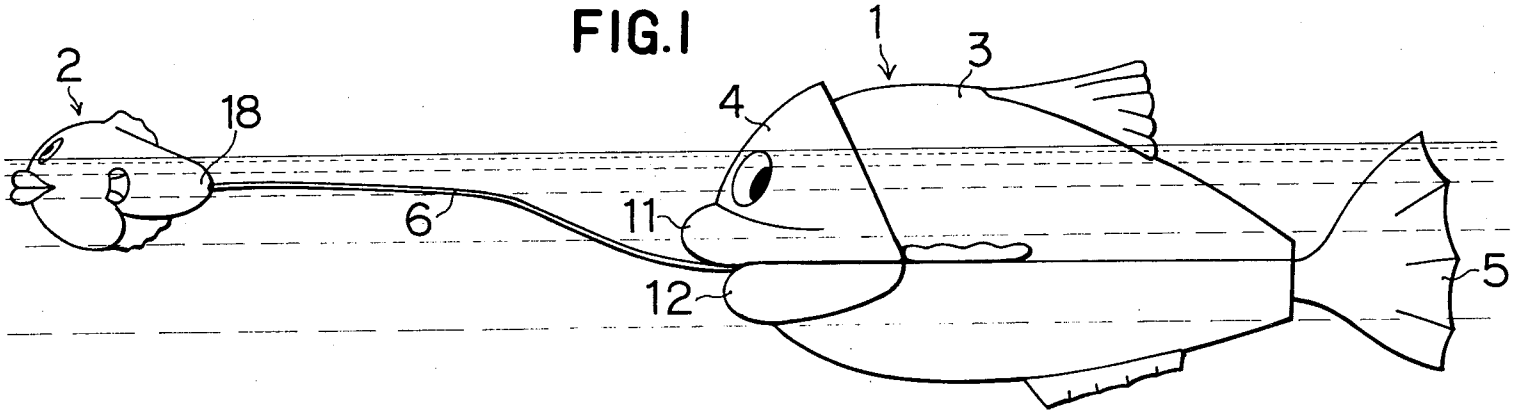
FIG. 1 is a side view illustrating a first embodiment of the toy according to this invention.

FIGS. 1 – 4 show an embodiment of the present invention wherein the large animal 1 is constituted as a fish, here a tuna, and the smaller animal 2 is similarly constituted as a fish. The larger animal is formed of a body part 3, a face part 4 and a tail 5. A line 6, here a flexible nylon cord, interconnects the two animals 1 and 2.

Figure 4:
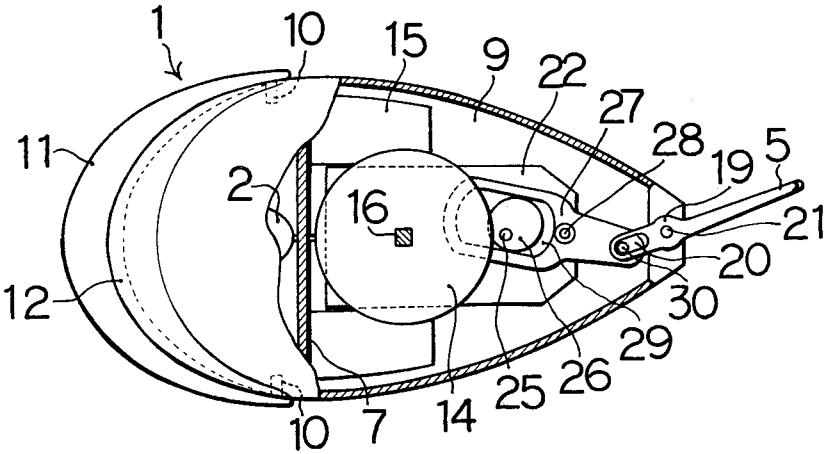
FIG. 4 is a top view partly in section showing the toy of FIG. 1 with the smaller toy completely inside it.

The large animal 1 is subdivided by a partition 7 into a front compartment 8 and a rear compartment 9. The face part 4 is hinged via pivots 10 on the body part 3 so that the face part 4 can pivot up as shown in FIG. 4 to receive the little fish 2 in the compartment 8. To this end the upper lip 11 and a lower lip 12 are both made relatively round so that the tail 18 of the small fish 2 will force them apart.

Inside the rear compartment 9 there is provided a float 15 that insures that the fish 1 will not sink completely, the fish 2 similarly being floatable. In addition this compartment 9 has a spring windup mechanism having a spring 13 carried on a shaft 16 that also carries a reel 14 on which the line 6 may be wound up. This line 6 passes through hole 17 in the partition 7 into the front compartment 8. The upper end of the shaft 16 is journalled in a frame plate 22 and carries a main drive gear 23 that meshes with the secondary drive gear 24 carried on a shaft 25 also journalled in the frame 22. This shaft 25 carries an eccentric disk 26 received in an elongated slot 29 in an element 27 pivoted about a vertical axis 28 on the plate 22. The rear end of this element 27 is provided with an upstanding pin 30 engaging in a slot 20 in a tailfin 5 having a hub 19 pivoted on the body 3 about a vertical axis 21.

The toy of FIGS. 1 – 4 is extremely simple in operation. The child using it need merely lift the face part 4 up and pull the small fish 2 from the mouth of the large fish 1. The small fish 2 is pulled out until the string 6 is fully extended. This extension automatically unwinds the string 6 from the reel 14 and winds up the spring 13. The two fish 1 and 2 are then placed in the water and released. The spring 23 will rotate the shaft 16 to wind the string 6 back up on the reel 14. In addition the rotation of the shaft 16 will oscillate the element 27 back and forth through the gear train 23, 24 and the eccentric 26 and will cause the rear fin 5 to pivot rapidly back and forth about the vertical axis 21. This oscillation of the fin or paddle 5 will cause the fish 1 to move forwardly in the water and appear to catch up with the smaller fish. Once the tail 18 of the smaller fish comes between the lips 11 and 12 the mouth formed thereby will open and the large fish 1 will appear to eat the small fish 2.

Figure 5:
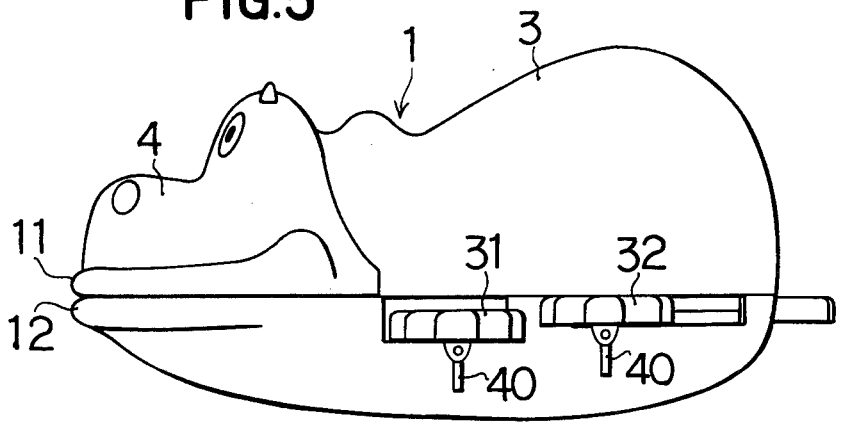
FIG. 5 is a side view similar to FIG. 3 showing another embodiment of the toy according to this invention.
Figure 6:
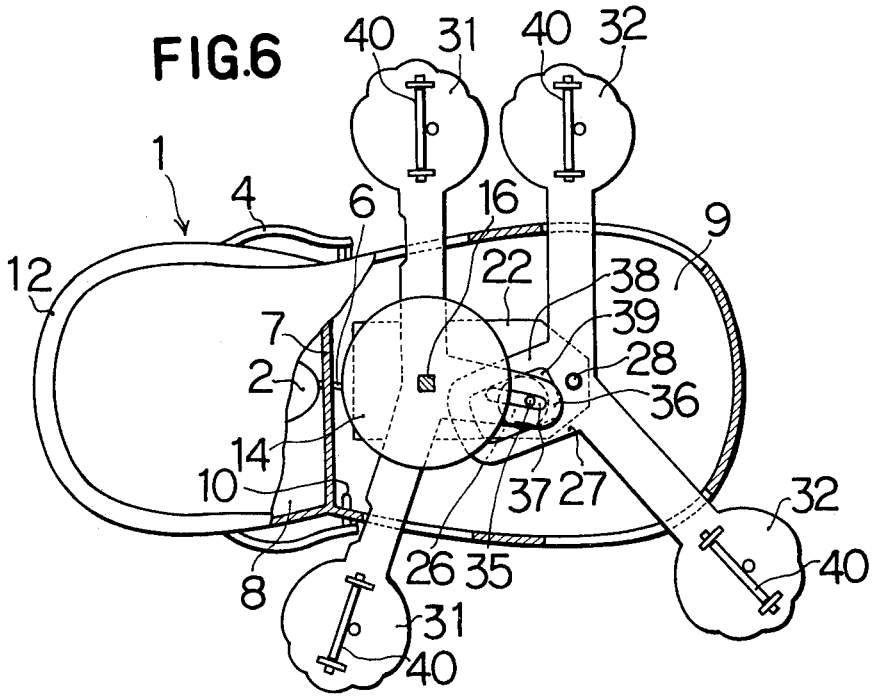
FIG. 6 is a bottom view partly in section of the toy of FIG. 5.

The arrangement of FIGS. 5 and 6 is functionally identical with that of FIGS. 1 – 4 and the same reference numerals are used wherever applicable to functionally identical structure. This arrangement is, however, provided with a body 1 formed as a hippopotamus having front feet 31 and rear feet 32 all carrying paddles 40 displaceable between upright positions as shown in FIG. 5 and horizontal positions extending backwardly from the feet 31 and 32.

The front feet 31 are both pivoted around the central axis 16 of the arrangement and have a rearwardly extending arm or lug 36 formed with a backwardly extending slot 37 in which engages an eccentric pin 35 carried on the cam 26. In addition this cam 26 fits within a large cutout 39 in a forwardly extending tab 38 of the rear feet 32 that are also jointly pivoted about the axis 28. Thus as the hippopotamus swims the feet on one side will move together as the feet on the other side move apart and vice versa, giving a realistic and amusing effect.

Figure 2:
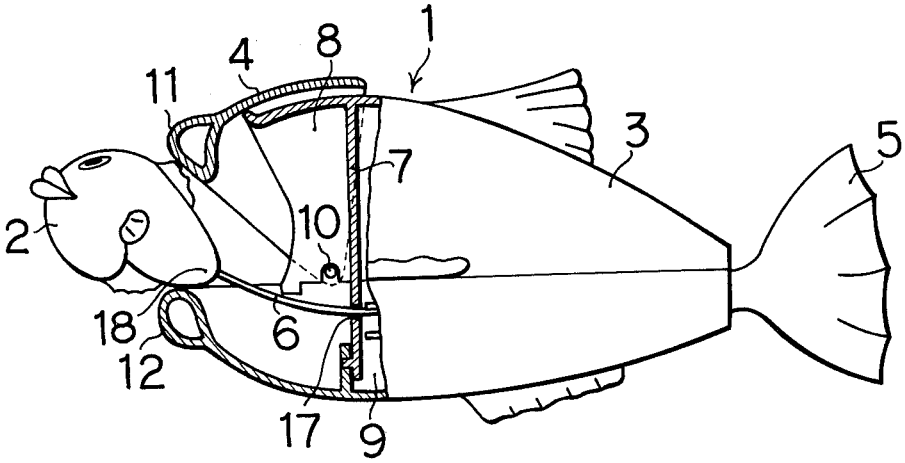
FIG. 2 is a side view partly in section of the toy of FIG. 1 showing the smaller animal partly swallowed.
Figure 3:
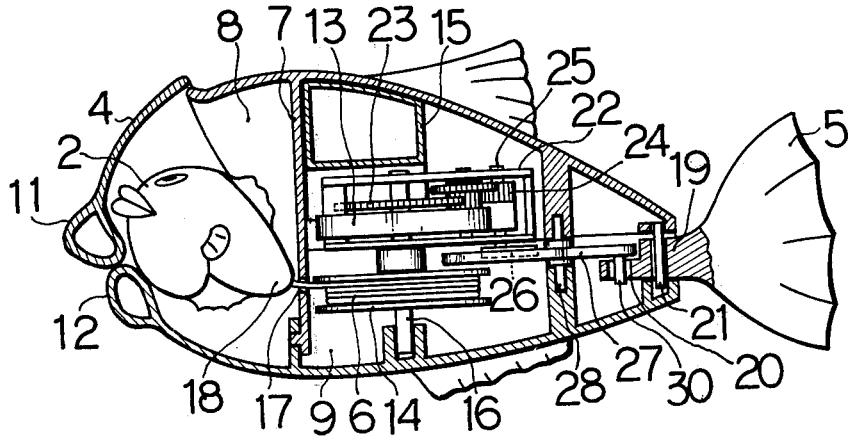
FIG. 3 is an axial section taken in the normal direction of travel through the toy of FIG. 1 showing the smaller animal completely swallowed.
Figure 7:
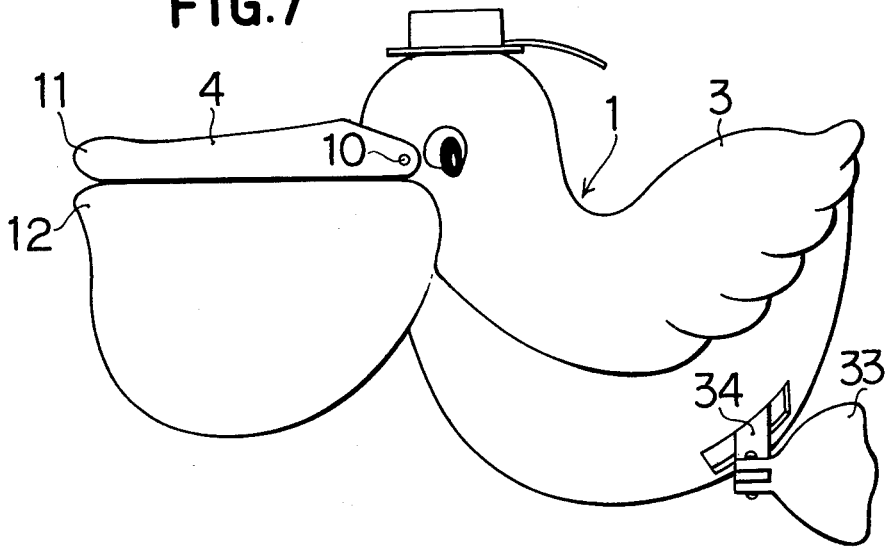
FIG. 7 is a side view of a third embodiment of the toy in accordance with this invention.
Figure 8:
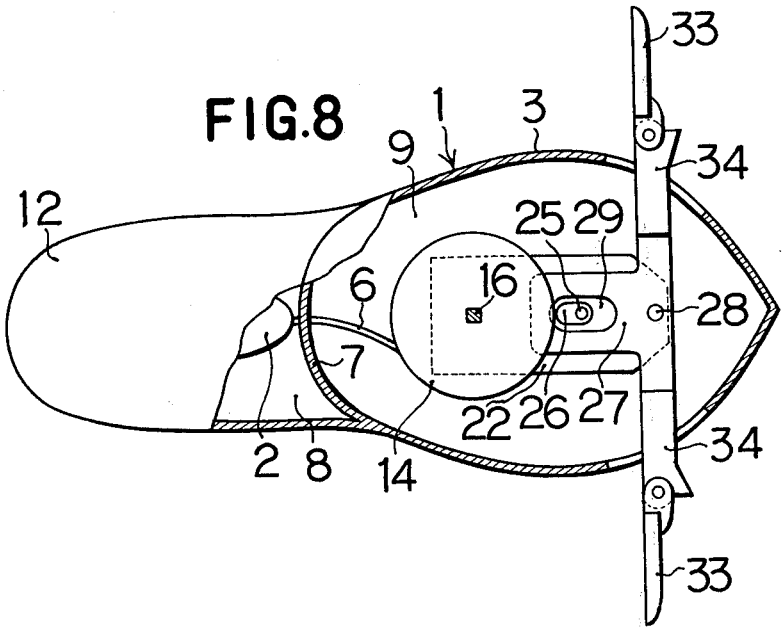
FIG. 8 is a top view partly in section of the toy of FIG. 7.

The arrangement in FIGS. 7 and 8 is formed generally as a pelican whose upper beak part 4 is hinged at 10 as described with reference to FIGS. 1 and 2. In this arrangement the cam 26 carried on the shaft 25 fits within the groove 29 of the element 27 as described with reference to FIG. 2. This element 27 however carries a pair of legs 34 that extend laterally outwardly from the housing 3 through holes in the side thereof and carry on their outer ends paddles 33 pivoted about upright axes. These paddles 33 are formed as small webed duck feet and can be displaced between the position shown in FIG. 7, extending backwardly in the direction of travel, and a position of FIG. 8 extending perpendicular to this direction of travel.

Thus this arrangement will be able to swim by alternate pushing with its web feet 33, the feet automatically swinging parallel to the body during forward movement so as to achieve an effective swimming propulsion.

It is also within the scope of this invention to connect one or more right-angle drives to the drive axis 25 and provide ground-engaging wheels at the ends of these drives in order to propel the arrangement along the ground. In such an arrangement the animal 1 would be constituted as a land animal, a cat or a bear, and the animal 2 as an animal the likely prey of this species, as a mouse.

It will be understood that each of the elements described above, or two or more together may also find a useful application in other types of structure differing from the types described above.

While the invention has been illustrated and described as embodied in a toy, it is not intended to be limited to the details shown since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A toy comprising:

a floatable and relatively small toy animal;

a floatable and relatively large toy animal having a generally hollow interior and an openable mouth;

a reel in said interior;

a paddle projecting from said large animal and movable to displace said large animal in a liquid;

a line having one end attached to said small animal and another end attached to said reel, said line passing through said mouth and being windable on said reel; and drive means including a spring windup mechanism in said interior attached to said reel and to said paddle for winding said line around said reel to pull said small animal into said interior through said mouth and to oscillate said paddle and thereby displace said large animal in a liquid in which same is floating.

2. The toy defined in claim 1 wherein said large animal has a body part and a face part hinged thereon and defining said mouth with said body part.

3. The toy animal defined in claim 2 wherein said windup mechanism has a windup spring with one end fixed in said large animal and another end secured to said reel, whereby pulling of said small animal away from said large animal winds up said spring.

4. The toy defined in claim 1 wherein said paddle is formed as a tailfin and said animals are both shaped like fish.

5. The toy defined in claim 1 wherein said large animal is provided with a plurality of feet each having one such paddle.

6. The toy defined in claim 5 wherein said paddles are hinged on said feet and displaceable thereon only through an angle of generally 90° between a horizontal position extending back from said mouth and a vertical position extending downwardly.

7. The toy defined in claim 1 wherein said large animal is formed as a bird and has a face part formed as a portion of a bill of said bird.

* * * * *